US011249435B2

(12) United States Patent
Chertov et al.

(10) Patent No.: US 11,249,435 B2
(45) Date of Patent: Feb. 15, 2022

(54) CLEANING A LIQUID ELECTROPHOTOGRAPHIC PRINTER

(71) Applicant: HP Indigo B.V., Amstelveen (NL)

(72) Inventors: Igor Chertov, Ness Ziona (IL); Doron Schlumm, Ness Ziona (IL); Shaul Zucker, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 26 days.

(21) Appl. No.: 16/606,211

(22) PCT Filed: Oct. 19, 2017

(86) PCT No.: PCT/EP2017/076720

§ 371 (c)(1),
(2) Date: Oct. 17, 2019

(87) PCT Pub. No.: WO2019/076460

PCT Pub. Date: Apr. 25, 2019

(65) Prior Publication Data

US 2021/0278795 A1 Sep. 9, 2021

(51) Int. Cl.
*G03G 21/00* (2006.01)
*G03G 13/11* (2006.01)
(Continued)

(52) U.S. Cl.
CPC ..... *G03G 21/0076* (2013.01); *G03G 13/11* (2013.01); *G03G 15/11* (2013.01);
(Continued)

(58) Field of Classification Search
CPC ..... G03G 21/0023; G03G 21/0088; G03G 13/11; G03G 15/11; G03G 21/0076; G03G 2221/0084
See application file for complete search history.

(56) References Cited

U.S. PATENT DOCUMENTS 6,644,190 B2 11/2003 Jones
7,929,878 B1 4/2011 Thayer et al.
(Continued)

FOREIGN PATENT DOCUMENTS

JP H086451 A * 1/1996 ..... G03G 21/10
JP H086451 A 1/1996
JP 2006227130 A 8/2006

OTHER PUBLICATIONS

Cleaning the Wiper Blade, Available online at: http://publications.lexmark.com/publications/pdfs/w820/eng/wiprclen.pdf.
(Continued)

*Primary Examiner* — Benjamin R Schmitt
(74) *Attorney, Agent, or Firm* — HP Inc. Patent Department

(57) ABSTRACT

An example cleaning station for a liquid electrophotographic printer is described. The cleaning station has a first cleaning member, a second cleaning member, and a biasing member. The cleaning station is configured to move between a first position and a second position with respect to a photo imaging member of the printer. In the first position, the first cleaning member is arranged to remove particles from the photo imaging member of the printer and the second cleaning member is arranged to apply a force to a layer of liquid applied to the photo imaging member. In the second position, the biasing member is configured to cause the second cleaning member to contact the first cleaning member to clean the second cleaning member.

11 Claims, 4 Drawing Sheets

(51) Int. Cl.
*G03G 15/11* (2006.01)
*G03G 15/10* (2006.01)

(52) U.S. Cl.
CPC ..... *G03G 21/0023* (2013.01); *G03G 21/0088* (2013.01); *G03G 15/10* (2013.01); *G03G 2221/0084* (2013.01)

(56) References Cited

U.S. PATENT DOCUMENTS

| | | | |
|---|---|---|---|
| 8,913,944 | B2 | 12/2014 | Sakon et al. |
| 9,031,470 | B2 | 5/2015 | Kahatabi et al. |
| 2012/0275836 | A1 | 11/2012 | Kadis et al. |

OTHER PUBLICATIONS

Xerox Phaser 8200 User Manual: Cleaning the Maintenance Drawer Wiper Blade, Available on the Internet at: https://www.manualslib.com/manual/169431/Xerox-Phaser-8200.html?page=80.

* cited by examiner

CLEANING A LIQUID ELECTROPHOTOGRAPHIC PRINTER

BACKGROUND

Liquid Electro-Photography (LEP) printing devices form images on print media by placing a uniform electrostatic charge on a photoreceptor in the form of a photo imaging plate (PIP) and then selectively discharging the PIP in correspondence with the images. The selective discharging forms a latent electrostatic image on the PIP. Ink comprising charged colorant particles suspended in imaging oil is then developed from a binary ink development (BID) unit on to the latent image formed on the PIP. The image developed on the PIP is offset to an image transfer element comprising a blanket, where it is heated until the solvent evaporates and the resinous colorants melt. This image layer is then transferred to the surface of the print media being supported on a transfer member.

BRIEF DESCRIPTION OF THE DRAWINGS

Various features of the present disclosure will be apparent from the detailed description which follows, taken in conjunction with the accompanying drawings, which together illustrate features of the present disclosure, and wherein.

DETAILED DESCRIPTION

Figure 1:
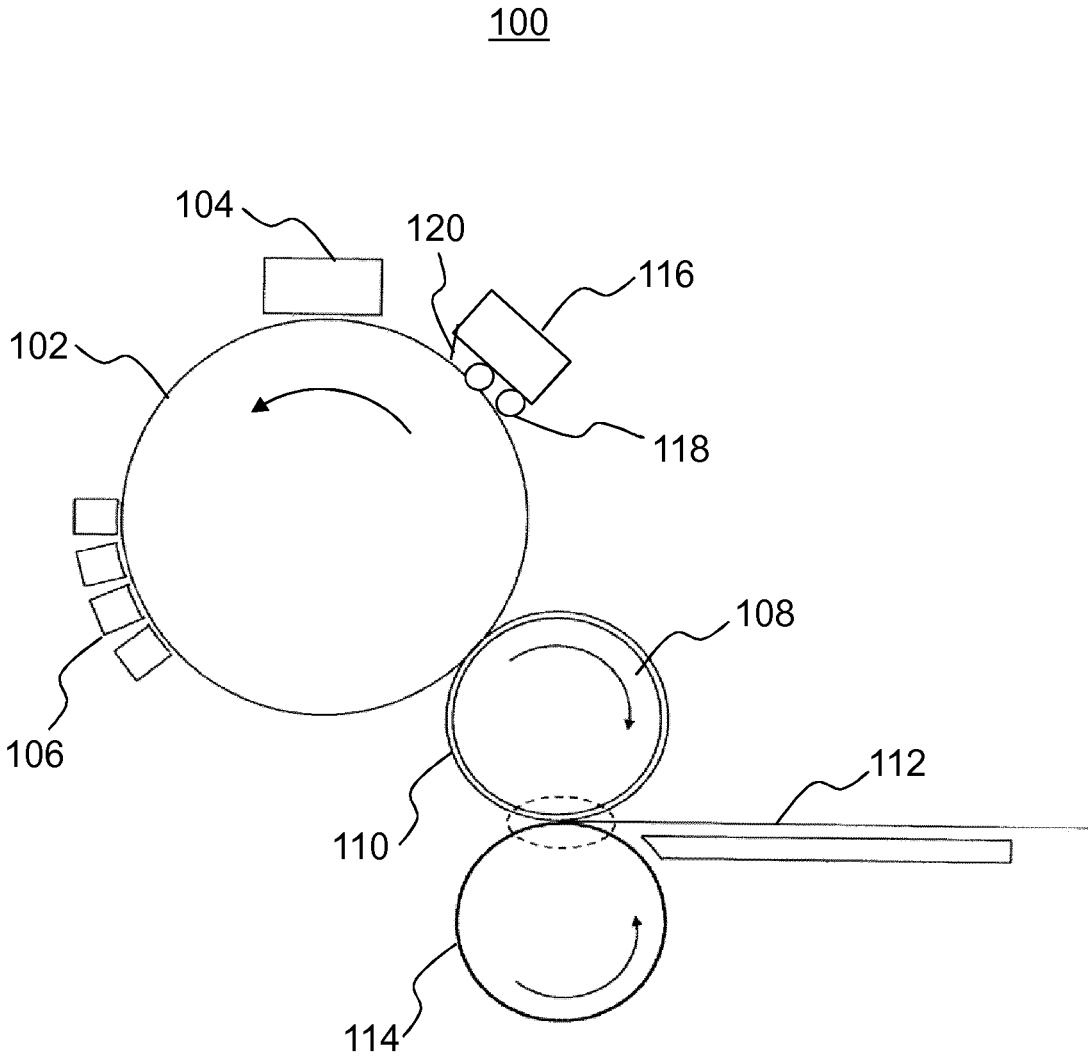
FIG. 1 is a schematic diagram showing a cross section of a print engine in a liquid electrophotographic printer according to an example.

Certain examples described herein relate to cleaning members for printing devices. For example, certain examples are directed to cleaning members for a photo-imaging member of a printing device. The printing device may be an LEP printing device. In certain cases, the photo-imaging member is a photo imaging plate (PIP), such as is mounted around a rotatable drum or cylinder.

In certain LEP printing devices, following transfer of ink from the PIP to a transfer member, such as a blanket of a rotating drum, the PIP passes a photo imaging plate cleaning station (referred to hereinafter as a cleaning station) to prepare the surface of the PIP for recharging and for a new latent image to be formed. The cleaning station may act to cool the PIP to a predetermined temperature by supplying cold fluid, such as imaging oil, to the surface of the PIP. The cleaning station may also clean the PIP of any fused ink debris that has become attached to it after being transferred from the blanket, and any un-fused ink that has not passed to the blanket. The cleaning station can have a plurality of cleaning members, such as one or more cleaning sponges to clean residual ink from the surface of the PIP, and one or more wiper blades to remove imaging oil from the surface of the PIP cleaned by the sponge(s) and to thereby control the amount of imaging oil applied to the PIP.

In certain cases, cleaning fluid, for example in the form of imaging oil, is applied to the sponges and then squeezed out by a separate squeezer to help remove the debris from the sponges. However, if not all of the debris particles are removed, then any remaining particles can, during subsequent rotation of the sponges, scratch a layer of imaging oil that has been deposited on the PIP. Particles may gather under the wiper, causing the removal of, or a change in, the thickness of the layer of imaging oil applied to the PIP in the lateral direction. Each of these changes in the deposited layer of imaging oil can cause a change in the lateral conductivity of the PIP. This may result in a print quality defect called "vertical scratches" or "vertical lines" on the print.

Certain examples described herein improve a cleaning station of an LEP printer. In examples, the cleaning station has a first cleaning member and a second cleaning member, and is configured to move between a first position and a second position with respect to a photo imaging plate of the printer. In the second position, a biasing member is configured to cause the second cleaning member to contact the first cleaning member to clean the second cleaning member. This can increase the efficiency of debris removal from the second cleaning member, and help to reduce and/or avoid print quality defects.

In the following description, for purposes of explanation, numerous specific details of certain examples are set forth. Reference in the specification to "an example" or similar language means that a particular feature, structure, or characteristic described in connection with the example is included in at least that one example, but not necessarily in other examples.

FIG. 1 illustrates example components of a print engine 100 in a liquid electrophotographic printer (LEP). The print engine 100 includes a photo imaging plate 102 (referred to hereinafter as a PIP), a latent image forming unit 104, and one or more binary ink development units 106 (referred to hereinafter as BID units) to develop an ink image on the PIP 102. The print engine 100 of FIG. 1 is shown as an example, other printing devices may vary in form or structure, e.g. a photo imaging member may be planar or part of a belt-driven system.

In the example print engine 100 of FIG. 1, a desired image is initially formed as a latent electrostatic image on the PIP 102. For example, an image is formed on the PIP 102 by rotating a clean, bare segment of the PIP 102 under the latent image forming unit 104. The latent image forming unit 104 may include a charging device, such as corona wire, charge roller, or other charging device, and a laser imaging portion. A uniform static charge may be deposited on the PIP 102 by the latent image forming unit 104. As the PIP 102 continues to rotate, a charged portion of the PIP 102 passes the laser imaging portion of the latent image forming unit 104. The laser imaging unit may dissipate localized charge in selected portions of the PIP 102 to leave a latent electrostatic charge pattern corresponding to an image to be printed. In some examples, the latent image forming unit 104 applies a negative charge to the surface of the PIP 102. In other examples, the charge may be a positive charge. The laser imaging portion of the latent image forming unit 104 may then locally discharge portions of the PIP 102, resulting in local neutralized regions on the PIP 102.

During a print cycle, at least one of the BID units 106 is engaged with the PIP 102. The engaged BID is to apply printing fluid, for example in the form of liquid ink, to the PIP 102. The liquid ink comprises electrically charged ink particles that are attracted to the oppositely charged portions of the PIP 102. The ink particles may be repelled from other areas of the PIP 102. The result is that an image is developed onto the latent electrostatic image provided on the PIP 102.

The print engine 100 also includes an image transfer member 108. In the Figure, this comprises a drum around which is wrapped a blanket 110, but in other cases may comprise a belt or other transport system. Following development of an image on the PIP 102, the PIP 102 continues to rotate and transfers the printing substance, in the form of the image, to the blanket layer 110. In some examples, the image transfer member 108 is electrically charged to facilitate transfer of the image to the blanket 110.

The image transfer member 108 transfers the image from the blanket 110 to a substrate 112 located between the image transfer member 108 and an impression cylinder 114. This process may be repeated, if more than one layer is to be included in a final image to be provided on the substrate 112. In certain other examples, an image may also be transferred directly from the PIP to the substrate.

Following transfer of ink from the PIP 102 to the image transfer member 108, the PIP 102 passes a photo-imaging plate cleaning station 116 (referred to hereinafter as a cleaning station) to prepare the surface of the PIP 102 for recharging and for a new latent image to be formed. The cleaning station can comprise one or more cleaning sponges 118, to clean residual ink from the surface of the PIP, and one or more wiper blades 120 to control the amount of imaging oil applied to the PIP. The surface of the PIP may comprise a thin film of conductive material that is referred to as the PIP foil. The thickness of the layer of imaging oil across the surface of the PIP foil affects the lateral conductivity of the PIP foil. Therefore, an even layer of imaging oil across the PIP foil ensures that there is minimal contrast in the lateral conductivity across the PIP foil, resulting in a high quality print.

A print quality defect referred to as "vertical lines" or "vertical scratches", in which the dot area of the printed image changes within a thin vertical area, can occur in LEP printers owing to the presence of an uneven layer of imaging oil over the PIP foil. This can occur for a number of reasons. For example, imaging oil is applied to the sponges and then squeezed out, using a squeezing component, to help remove particles such as fused ink debris from the sponges; however, in practice not all of the debris particles may be removed from the sponges and remaining particles can scratch the deposited layer of imaging oil on the PIP foil during subsequent rotations of the sponges. The scratched area has the original lateral conductivity of the PIP foil, creating a difference between the lateral conductivity of the scratched area and that of the rest of the PIP foil. Particles that have not been removed from the sponges may also gather under the wiper, affecting the wiper's ability to control the thickness of the imaging oil applied to the PIP in the lateral direction, and resulting in an uneven layer and, consequently, areas of contrasting lateral conductivity. Non-uniformity in printed output quality is commonly referred to as OPS (old photoconductor syndrome).

In order to clean the wiper, the printer is switched off (the wiper being out of contact with the PIP at this stage) and the wiper is manually cleaned with a cloth. The wiper can be removed in order to do this, or cleaned in situ. This occurs at least once a day, for example before the first print of the day, but an operator of the printer can monitor contamination of the wiper over time and may have to turn off the printer in order to clean the wiper multiple times each day.

Figure 2:
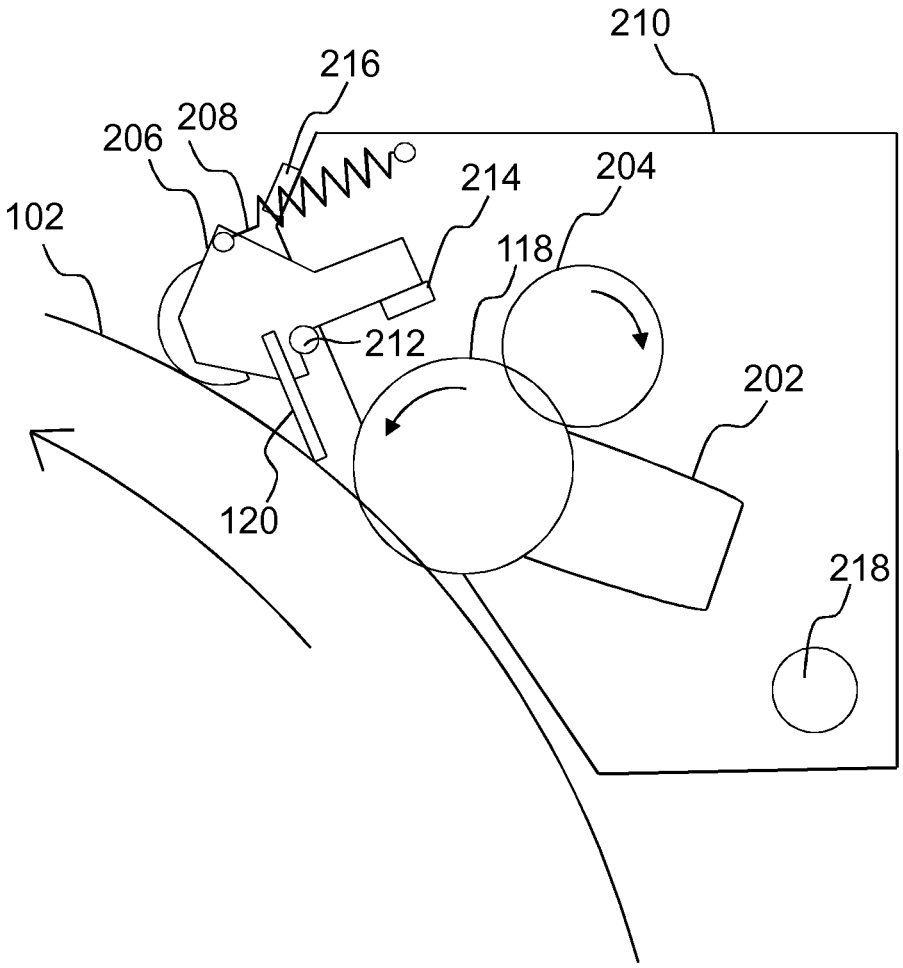
FIG. 2 is a schematic diagram showing a cross section of a cleaning station of a liquid electrophotographic printer in a first position relative to a photo imaging plate of a liquid electrophotographic printer, according to an example.

FIG. 2 illustrates the components of a cleaning station 200 in a first, engaged position with respect to the PIP, according to an example. The cleaning station may be used to help alleviate the print quality defects described above.

The cleaning station 200 comprises a first cleaning member, which may be, for example, a sponge 118 that is arranged to remove particles from the PIP 102 of the LEP printer. The first cleaning component is formed of a soft, compressible material, such as a sponge, brush or microcellular (polymer) material that will not damage the PIP during removal of the particles. This material can be glued to a rotatable core, such as a hollow metal cylinder. In the example of FIG. 2, the sponge 118 and PIP 102 rotate anti-clockwise, but they could alternatively be arranged to both rotate clockwise. In FIG. 2, a single first cleaning component in the form of a single sponge 118 is shown, but multiple first cleaning components can be provided. As their surfaces pass one another, the sponge collects particles such as ink debris and dust from the surface of the PIP 102. A fluid supply, in the form of a pump 202, can apply a cleaning fluid to the sponge 118. The cleaning fluid may be imaging oil. One or more squeezing components 204, such as rotatable squeezers, are arranged to squeeze the sponge 118 in order to remove the cleaning fluid and particles from the sponge 118. Many of the particles can then be flushed from the squeezing components 204 into a cleaning station bath (not shown). The particles are subsequently filtered from the cleaning fluid. In an example in which the cleaning fluid is imaging oil, the filtered imaging oil can be recycled for application to the PIP 102.

The cleaning station 200 also comprises a second cleaning member, which may be, for example, a wiper 120 that is arranged to apply a force to a layer of liquid applied to the photo imaging plate. The wiper 120 is held by a wiper housing 206, which may be formed of aluminium or a similar material by extrusion. The wiper 120 may be formed of solid polyurethane and is fixed within the wiper housing 206. The wiper 120 can be configured to have some flexibility when a force is applied to its tip, for example by the PIP 102, such that it exerts a suitable pressure on the PIP 102.

A biasing member 208, such as a spring or extension spring, is attached between the wiper housing 206 and a fixed part of the cleaning station 200, such as a cleaning station housing 210 or an internal component of the cleaning station 200 that does not move relative to the cleaning station housing 210. The biasing member 208 is configured such that, in the engaged position, a force generated by the PIP surface overcomes the biasing force; the force applied by the biasing member 208 is weaker than the reactive force generated by the PIP 102 surface. Therefore, the presence of the biasing member 208 does not adversely affect the positioning or functioning of the cleaning station components in the engaged position. A wiper housing axis 212 and stopper members 214 and 216 can also be provided, as explained further with respect to FIG. 3 below. As can be seen in FIG. 2, a lower stopper member 214 can contact the wiper housing 206 to define a position of the wiper 120 when the cleaning station 200 is in the engaged position.

Figure 3:
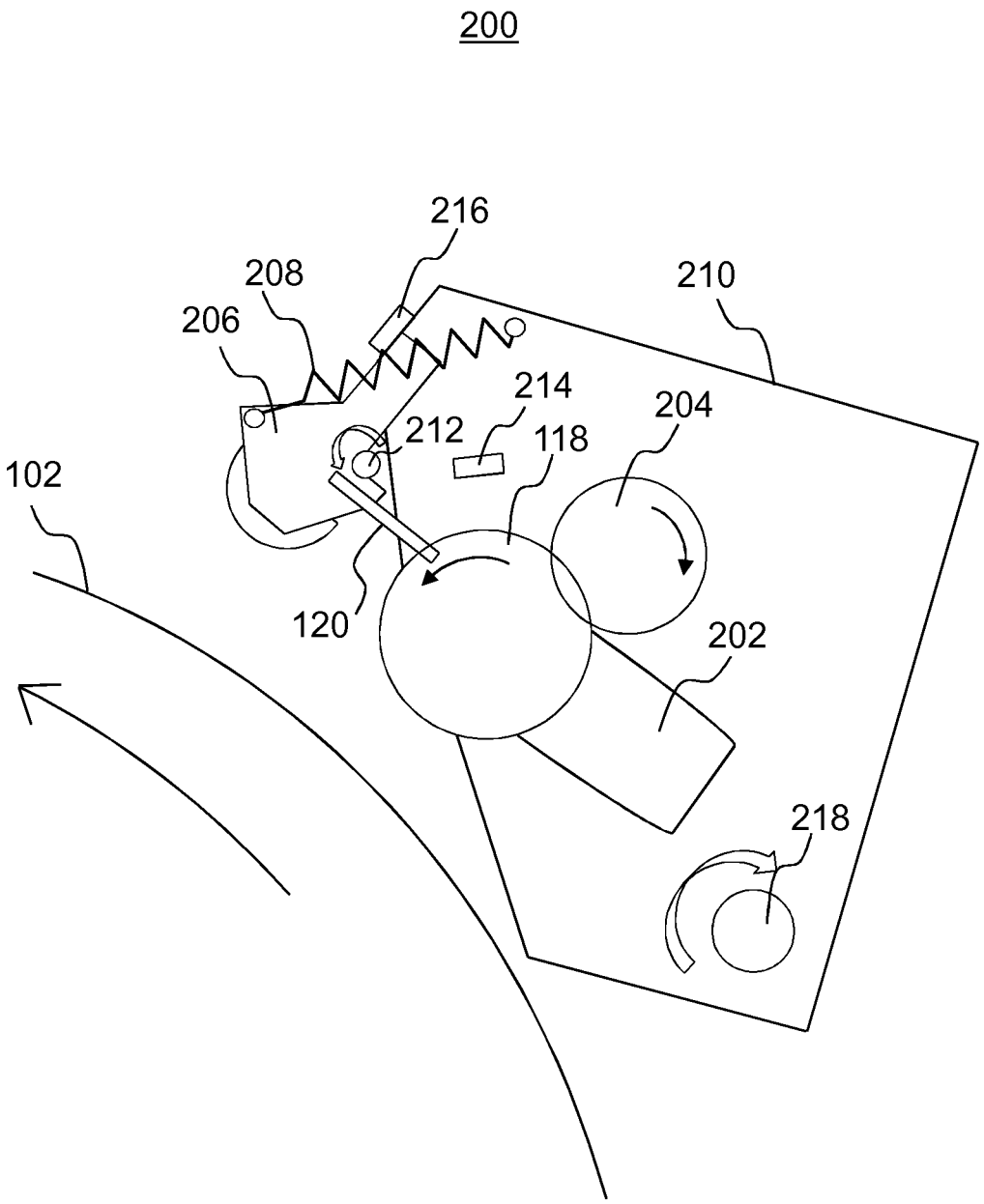
FIG. 3 is a schematic diagram showing a cross section of the cleaning station of FIG. 2 in a second position relative to the photo imaging plate, according to an example.

FIG. 3 illustrates the components of the cleaning station 200 of FIG. 2 in a second, disengaged position with respect to the PIP, according to an example.

The cleaning station 200 is arranged to rotate on a cleaning station axis 218 between the first, engaged position as shown in FIG. 2 and a second, disengaged position as shown in FIG. 3. In the disengaged position, the components of the cleaning station 200 such as the first and second cleaning members do not contact the PIP 102. In moving between the engaged and disengaged positions, the entire cleaning station housing 210 is arranged to rotate or pivot about the cleaning station axis 218.

Referring to FIG. 3, in the second, disengaged position, the biasing member 208 is configured to cause the second cleaning member, in the form of the wiper 120, to contact the first cleaning member, in the form of the sponge 118. The wiper 120 is moveably mounted within the cleaning station housing 210. For example, the wiper 120 can be configured to pivot about the wiper housing axis 212 so as to contact the rotatable sponge 118. In this position, the sponge 118 is able to clean the wiper 120 by rotating against it. An upper stopper member 216 can contact the wiper housing 206 to define a position of the wiper 120 when the cleaning station 200 is in the disengaged position.

Therefore, it can be seen from FIGS. 2 and 3 that the biasing member 208 allows the wiper 120 to move in and out of contact with the rotatable sponge 118 as the cleaning station 200 moves between the disengaged and engaged positions, respectively. Such a mechanical mechanism allows automatic cleaning of the wiper 120 without the need for an electrical actuator or sensor. In an example, the movement of the wiper 120 is aided by the wiper housing axis 212, about which the wiper housing 212 can pivot, and the lower stopper member 214 and upper stopper member 216, which are arranged to limit the movement of the wiper 120.

As noted with respect to FIG. 2, a fluid supply, in the form of a pump 202, can apply a cleaning fluid to the sponge 118. Therefore, when the cleaning station is in the disengaged position, cleaning fluid from sponge 118 wets the wiper 120. Applying fluid to the wiper tip in this way reduces the chance of wiper erosion and hence increases the wiper's lifespan.

Figure 4:
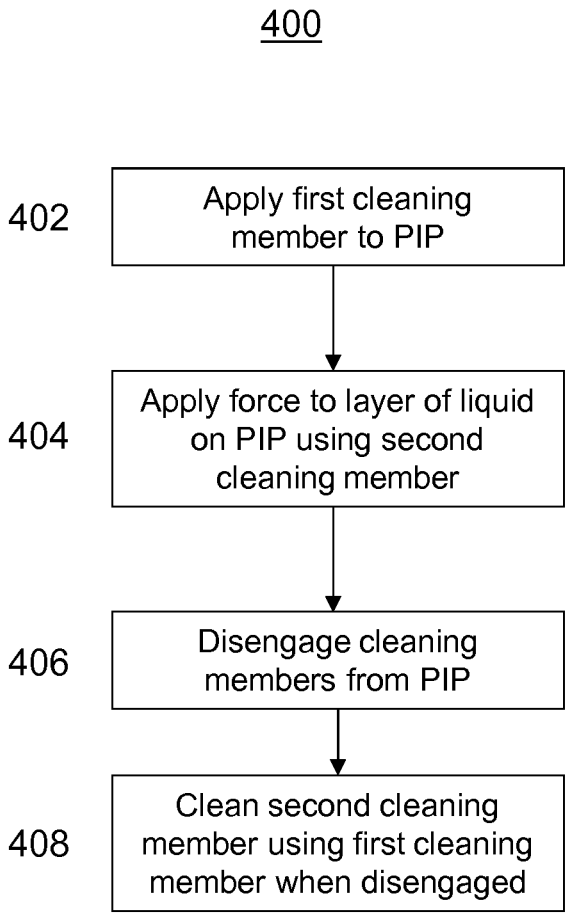
FIG. 4 is a flow diagram showing a method of operating a cleaning station of a liquid electrophotographic printer according to an example.

FIG. 4 is a flow diagram showing a method 400 of operating a cleaning station such as the cleaning station 200 described with reference to FIGS. 2 and 2, according to an example.

At block 402, a first cleaning member, for example in the form of sponge 118, is applied to the PIP 102 of the printer to remove particles from the PIP 102. At this point, a cleaning station is in an engaged position.

At block 404, a second cleaning member, for example the wiper 120, applies a force to a layer of liquid, such as imaging oil, that is applied to the PIP 102.

At block 406, the sponge 118 and wiper 120 are disengaged from the PIP 102. This may be achieved by moving the cleaning station 200 out of contact with the PIP 102 and, during disengaging, moving the wiper 120 into contact with the sponge 118, as explained above with reference to FIGS. 2 and 3.

At block 408, when the sponge 118 and the wiper 120 are disengaged from the PIP 102, the sponge 118 is used to clean the wiper 120.

The cleaning station 200 can be used to automatically clean the wiper 120 before printing starts and after printing has finished, as the biasing member 208 can cause the wiper 120 to contact the sponge 118 during existing engage and disengage sequences. The liquid electrophotographic printer has a number of states, such as "off", "standby", "get ready" and "print". To manually clean the wiper 120, the printer is turned off completely. However, the printer need not be turned off in order to automatically clean of the wiper 120 in the disengaged position.

An example engage sequence, for engaging the cleaning station 200 with the PIP 102, includes starting a motor to rotate the sponge 118. Thereafter, the pump 202 is started to apply cleaning fluid (which may also act to cool the PIP 102) to the sponge 118. There is then a wait of an appropriate period of time, for example approximately 4 seconds, to allow the fluid flow to stabilize; this can be referred to as a "pre-printing" stage. It is at this point that the rotating sponge 118 and wiper 120 are in contact while the cleaning station 200 is disengaged from the PIP 102, and there is time for the rotating sponge 118 to clean the wiper 120. Subsequently, pneumatic pistons (not shown) can push the cleaning station 200 to rotate on the cleaning station axis 218 towards the PIP 102. This moves the cleaning station 200 to the engaged position, the wiper 120 is moved out of contact with the sponge 118 and the sponge 118 and wiper 120 are applied to the PIP 102.

An example disengage sequence, for disengaging the cleaning station 200 with the PIP 102, begins when the pneumatic pistons stop pushing the cleaning station 200 towards the PIP 102, and a retaining spring (not shown) attached to the cleaning station 200 applies a force to rotate the cleaning station 200 on the cleaning station axis 218 to the disengaged position (as shown in FIG. 3). Thereafter, the pump 202 is turned off to stop the flow of fluid to the sponge 118. There is then a wait of an appropriate period of time, for example approximately 4 seconds, to allow the rotating sponge to dry; this can be referred to as a "post-printing" stage. It is at this point that the rotating sponge 118 and wiper 120 are in contact while the cleaning station 200 is disengaged from the PIP 102, and there is time for the rotating sponge 118 to clean the wiper 120. Subsequently, the motor is turned off to stop rotation of the sponge 118. At this point, the printer may be in a "standby" stage.

Therefore, there is no need to manually clean the wiper 120, and the likelihood of particles such as ink debris becoming trapped under the wiper 120, and causing print quality issues, is greatly reduced.

The preceding description has been presented to illustrate and describe examples of the principles described. This description is not intended to be exhaustive or to limit these principles to any precise form disclosed. Many modifications and variations are possible in light of the above teaching. It is to be understood that any feature described in relation to any one example may be used alone, or in combination with other features described, and may also be used in combination with any features of any other of the examples, or any combination of any other of the examples.

What is claimed is:

1. A cleaning station for a liquid electrophotographic printer comprising:

a first cleaning member;

a second cleaning member; and a spring attached between the cleaning station and the second cleaning member;

wherein the cleaning station is configured to move between a first position and a second position with respect to a photo imaging member of the printer;

wherein:

in the first position, the first cleaning member is arranged to remove particles from the photo imaging member of the printer and the second cleaning member is arranged to apply a force to a layer of liquid applied to the photo imaging member;

in the second position, the spring is configured to cause the second cleaning member to contact the first cleaning member to clean the second cleaning member; and the spring is configured to move the second cleaning member in and out of contact with the first cleaning member as the cleaning station moves between the second and first positions respectively.

2. The cleaning station of claim 1, wherein the spring is configured to cause the second cleaning member to pivot about an axis in order to contact the first cleaning member.

3. The cleaning station of claim 1, wherein the photo imaging member comprises a rotatable drum.

4. The cleaning station of claim 1, further comprising a fluid supply arranged to apply cleaning fluid to the first cleaning member such that, when the cleaning station is in the second position, cleaning fluid from the first cleaning member wets the second cleaning member.

5. A liquid electrophotographic printer comprising:

a photo imaging plate;

a housing moveable between an engaged position and a disengaged position, the housing comprising:

a rotatable sponge to, in the engaged position, remove particles from the photo imaging plate;

a wiper to, in the engaged position, apply a force to a layer of liquid applied to the photo imaging plate, wherein the wiper is moveably mounted within the housing such that, in the disengaged position, the wiper contacts the rotatable sponge to clean the wiper; and a spring attached between the housing and the wiper, the spring being configured to move the wiper in and out of contact with the rotatable sponge as the housing moves between the disengaged position and the engaged position, respectively.

6. The liquid electrophotographic printer of claim 5, wherein the wiper is configured to pivot about an axis so as to contact the rotatable sponge.

7. The liquid electrophotographic printer of claim 5, wherein the photo imaging plate is mounted upon a rotating drum.

8. The liquid electrophotographic printer of claim 5, further comprising a fluid supply arranged to apply cleaning fluid to the rotatable sponge such that, when the housing is in the disengaged position, cleaning fluid from the rotatable sponge wets the wiper.

9. A method of cleaning a liquid electrophotographic printer, the method comprising:

providing a housing moveable between an engaged position and a disengaged position, the housing comprising a rotatable sponge, a wiper movably mounted within the housing, and a spring attached between the housing and the wiper;

causing the rotatable sponge to, in the engaged position, remove particles from the photo imaging plate;

causing the wiper to, in the engaged position, apply a force to a layer of liquid applied to the photo imaging plate causing the wiper, in the disengaged position, to contact the rotatable sponge to clean the wiper, wherein the spring is to move the wiper in and out of contact with the rotatable sponge as the housing moves between the disengaged position and the engaged position.

10. The method of claim 9, wherein the wiper pivots about an axis so as to contact the rotatable sponge.

11. The method of claim 9, utilizing a fluid supply to apply cleaning fluid to the rotatable sponge such that, when the housing is in the disengaged position, cleaning fluid from the rotatable sponge wets the wiper.

* * * * *